US010024592B2

(12) United States Patent
Kim et al.

(10) Patent No.: US 10,024,592 B2
(45) Date of Patent: Jul. 17, 2018

(54) REFRIGERATOR AND METHOD OF FABRICATING INNER DOOR THEREOF

(71) Applicant: SAMSUNG ELECTRONICS CO., LTD., Suwon-si (KR)

(72) Inventors: Byoung Mok Kim, Gwangju (KR); Yong Man Seo, Gwangju (KR); Young Jae Song, Gwangju-si (KR); Jae Hyun Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/726,007

(22) Filed: Oct. 5, 2017

(65) Prior Publication Data

US 2018/0031303 A1 Feb. 1, 2018

Related U.S. Application Data

(63) Continuation of application No. 14/073,066, filed on Nov. 6, 2013, now Pat. No. 9,810,475.

(30) Foreign Application Priority Data

Nov. 9, 2012 (KR) ..... 10-2012-0126892

(51) Int. Cl.
*F25D 23/00* (2006.01)
*F25D 23/02* (2006.01)
*F25D 23/08* (2006.01)

(52) U.S. Cl.
CPC ..... *F25D 23/028* (2013.01); *F25D 23/02* (2013.01); *F25D 23/025* (2013.01); *F25D 23/087* (2013.01); *F25D 2323/021* (2013.01)

(58) Field of Classification Search
CPC ..... F25D 23/025; F25D 23/028; F25D 23/04; F25D 11/02; F25D 2323/021; E05Y 2900/31
See application file for complete search history.

(56) References Cited

U.S. PATENT DOCUMENTS 2,942,438 A * 6/1960 Schmeling ..... F25D 23/04 62/377
4,583,796 A * 4/1986 Nakajima ..... F25D 23/02 312/296

(Continued)

FOREIGN PATENT DOCUMENTS

CN 101107488 A 1/2008
JP 2003-139467 A 5/2003

(Continued)

OTHER PUBLICATIONS

Extended European Search Report dated May 15, 2017 in related European Patent Application No. 13191907.8.

(Continued)

*Primary Examiner* — Daniel J Rohrhoff
(74) *Attorney, Agent, or Firm* — Staas & Halsey LLP

(57) ABSTRACT

A refrigerator includes a storage compartment, an inner door including an opening having a size corresponding to the size of the storage compartment, a plurality of door guards disposed in the opening, and an outer door that opens or closes the opening, wherein the inner door includes inner sidewalls that are disposed at both sides of the opening and are flat from an inlet of the opening to an outlet of the opening without any curve.

7 Claims, 15 Drawing Sheets

(56) References Cited

U.S. PATENT DOCUMENTS

| | | | | | |
|---|---|---|---|---|---|
| 4,617,759 | A * | 10/1986 | Pasqualini | F25D 23/082 | 312/405 |
| 4,884,415 | A * | 12/1989 | Mandel | F25D 21/04 | 312/405 |
| 5,476,318 | A * | 12/1995 | Yingst | E05B 1/0015 | 312/405 |
| 5,966,963 | A * | 10/1999 | Kovalaske | F25D 23/02 | 312/405 |
| 6,056,383 | A * | 5/2000 | Banicevic | F25D 23/082 | 312/401 |
| 7,140,159 | B2 * | 11/2006 | Avendano | F25D 23/082 | 52/784.1 |
| 7,659,491 | B2 | 2/2010 | Yang | | |
| 7,726,756 | B2 | 6/2010 | Fu | | |
| 8,752,918 | B2 | 6/2014 | Kang | | |
| 8,801,124 | B2 | 8/2014 | Jung | | |
| 8,814,284 | B2 | 8/2014 | Lee | | |
| 9,810,475 | B2 * | 11/2017 | Kim | F25D 23/028 | |

FOREIGN PATENT DOCUMENTS

| | | | |
|---|---|---|---|
| JP | 2011-069612 | A | 4/2011 |
| KR | 10-2012-0063316 | | 6/2012 |
| WO | WO 2010/131813 | A1 | 11/2010 |
| WO | WO 2011/081279 | A1 | 7/2011 |

OTHER PUBLICATIONS

Non-Final Office Action dated Aug. 14, 2015 in parent U.S. Appl. No. 14/073,066.

Restriction Office Action dated Apr. 2, 2015 in parent U.S. Appl. No. 14/073,066.

Advisory Action dated May 20, 2016 in parent U.S. Appl. No. 14/073,066.

Final Office Action dated Mar. 7, 2016 in parent U.S. Appl. No. 14/073,066.

Non-Final Office Action dated Sep. 27, 2016 in parent U.S. Appl. No. 14/073,066.

Notice of Allowance dated Jul. 21, 2017 in parent U.S. Appl. No. 14/073,066.

Corrected Notice of Allowance dated Aug. 17, 2017 in parent U.S. Appl. No. 14/073,066.

* cited by examiner

REFRIGERATOR AND METHOD OF FABRICATING INNER DOOR THEREOF

CROSS-REFERENCE TO RELATED APPLICATIONS

This application is a continuation of U.S. patent application Ser. No. 14/073,066, filed Nov. 6, 2013, which claims the priority benefit of Korean Patent Application No. 10-2012-0126892, filed on Nov. 9, 2012 in the Korean Intellectual Property Office, the disclosure of which is incorporated herein by reference.

BACKGROUND

1. Field

The following description relates to a refrigerator including an inner door having an opening, door guards disposed in the opening, and an outer door that opens or closes the opening.

2. Description of the Related Art

In general, a refrigerator is a home appliance that keeps food fresh for a long term by including a storage compartment to store food and a cold air supplying unit to supply cold air to the storage compartment.

A shelf is provided in the storage compartment, and thus food may be put on the shelf. The storage compartment may be provided so that a front portion of the storage compartment is open so as to put food in or to take food out from the storage compartment, and the open front portion of the storage compartment may be opened or closed by a main door that is rotatably combined with a body. Door guards in which food is stored separately from the shelf disposed in the storage compartment, may be disposed at a rear portion of the main door.

Since these door guards are disposed at the rear portion of the main door, the main door must be opened to approach the door guards. There is a refrigerator including an additional auxiliary door disposed at the main door so that a user may approach the door guards without opening the main door. Since the refrigerator including such an auxiliary door allows the user to approach the door guards disposed at the rear portion of the main door by opening only the auxiliary door without opening the main door, variety in food storage is improved and the effect of cold air preservation may be obtained.

However, since the size of the auxiliary door is limited, the user may approach only some of a plurality of door guards disposed at the rear portion of the main door in a vertical direction.

SUMMARY

Therefore, it is an aspect of the present disclosure to provide a refrigerator that enables a user to approach all of a plurality of door guards disposed at a main door by opening only an auxiliary door without opening the main door, and a method of fabricating an inner door of the refrigerator.

Additional aspects of the disclosure will be set forth in part in the description which follows and, in part, will be apparent from the description, or may be learned by practice of the disclosure.

In accordance with one aspect of the present disclosure, a refrigerator includes: a body; a storage compartment formed in the body; an inner door including an opening corresponding to the storage compartment, an inner plate, an outer plate in which a foaming space between the outer plate and the inner plate is formed, and a heat insulating material that foams in the foaming space, the inner door rotatably combined with the body; a plurality of door guards disposed in the opening; and an outer door rotatably combined with the body so as to open or close the opening, wherein the inner plate includes a plurality of inner sidewalls that constitute the opening and support the plurality of door guards, the plurality of inner sidewalls are flat from an inlet of the opening to an outlet of the opening and a distance between the plurality of inner sidewalls is uniform from the inlet of the opening to the outlet of the opening, and the inner plate may be integrally injection-molded.

The inner door may further include a door trim combined in a space between the inner plate and the outer plate so as to prevent a foaming solution in the foaming space from leaking toward the opening.

The door trim may include a first insertion groove in which an end of the inner plate is closely adhered and inserted, and a second insertion groove in which an end of the outer plate is closely adhered and inserted.

The door trim may be combined in a space between the inner plate and the outer plate before the foaming solution is injected and foams in the foaming space. The outer plate may include a combination protrusion via which the outer plate is combined with the door trim, and the door trim may include a combination groove in which the combination protrusion is inserted.

The refrigerator may further include support protrusions that protrude from the inner sidewalls so as to support the door guards.

No additional door guard may be disposed in the external door.

In accordance with another aspect of the present disclosure, a refrigerator includes: a body; a storage compartment formed in the body; an inner door including an opening corresponding to the storage compartment, an inner plate, an outer plate, and a heat insulating material that is disposed between the inner plate and the outer plate, the inner door rotatably combined with the body; an outer door rotatably combined with the body so as to open or close the opening; and a plurality of door guards arranged in the opening in a vertical direction, wherein the inner plate includes a plurality of inner sidewalls that are disposed at both sides of the opening so as to support the plurality of door guards, the plurality of inner sidewalls being flat from an inlet of the opening to an outlet of the opening, the inner plate is integrally injection-molded, and the door guards are disposed between the plurality of inner sidewalls.

The door guards each may include a front wall, a rear wall, both sidewalls, a bottom wall, and a storage space.

The front wall of each door guard may not be covered by the inner door and may be fully exposed.

The front wall of each door guard may constitute a part of a front portion of the inner door.

In accordance with still another aspect of the present disclosure, a refrigerator includes: a body; a storage compartment formed in the body; an inner door including an opening corresponding to the storage compartment and rotatably combined with the body; a plurality of door guards disposed in the opening; and an outer door rotatably combined with the body so as to open or close the opening, wherein the inner door includes; an inner plate having a plurality of inner sidewalls that are disposed at both sides of the opening so as to support the plurality of door guards and that are flat from an inlet of the opening to an outlet of the opening; an outer plate in which a foaming space between the outer plate and the inner plate is formed; and a door trim combined in a space between the inner sidewalls of the inner plate and the outer plate so as to prevent a foaming solution that foams in the foaming space from leaking toward the opening.

The door trim may include a first insertion groove in which an end of the inner sidewall of the inner plate is closely adhered and inserted, and a second insertion groove in which an end of the outer plate is closely adhered and inserted.

In accordance with yet still another aspect of the present disclosure, a method of fabricating an inner door of a refrigerator including a body, a storage compartment formed in the body, the inner door including an opening corresponding to the storage compartment and rotatably combined with the body, a plurality of door guards disposed in the opening, and an outer door rotatably combined with the body so as to open or close the opening, the method including injection-molding an inner plate having inner sidewalls that are flat from an inlet of the opening to an outlet of the opening.

The method may further include: preparing an outer plate in which a foaming space between the outer plate and the inner plate is formed; preparing a door trim combined in a space between the inner plate and the outer plate so as to prevent a foaming solution that foams in the foaming space from leaking toward the opening; preparatorily combining the inner plate, the outer plate, and the door trim with each other; and injecting and foaming the foaming solution in the foaming space to securely combine the inner plate, the outer plate, and the door trim with each other.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
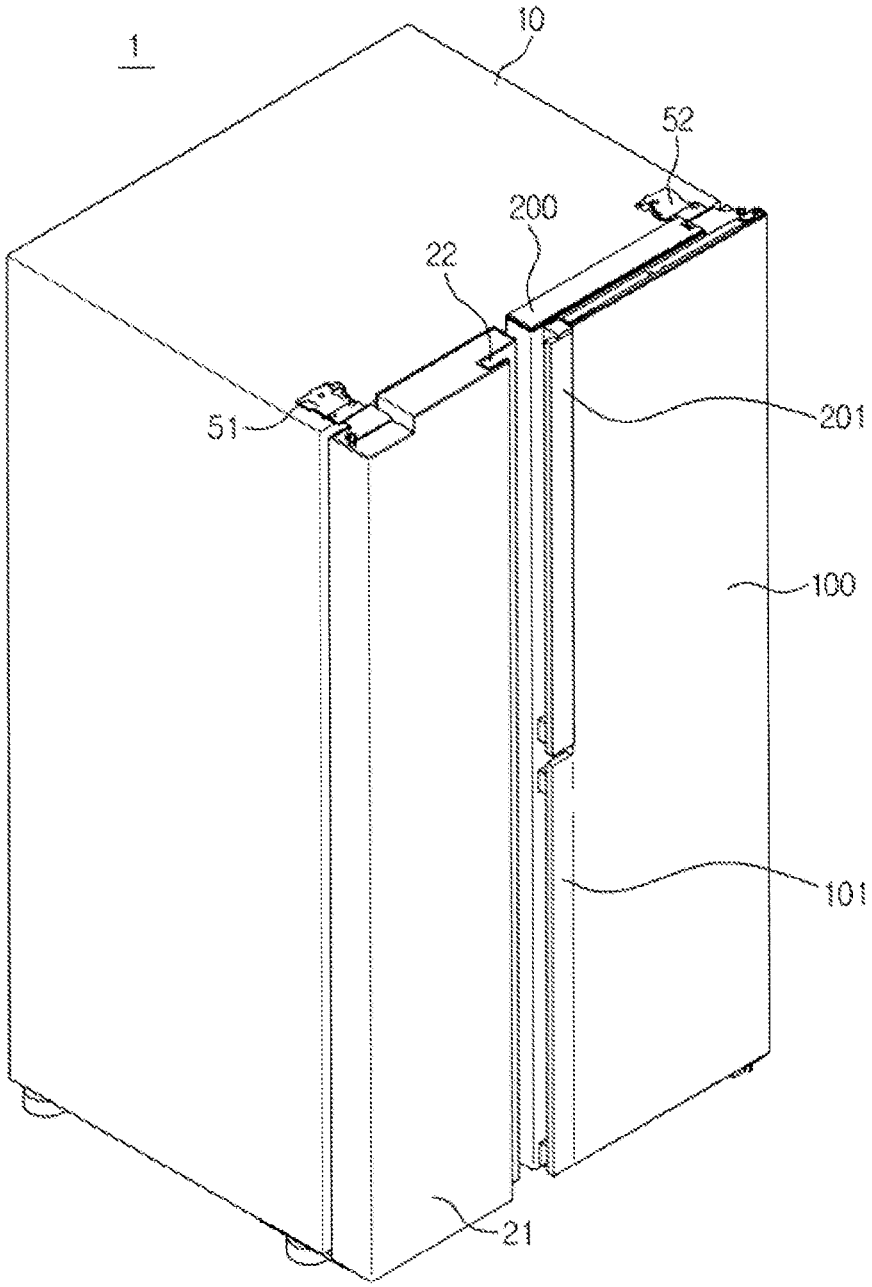
FIG. 1 is a view illustrating a state in which both an inner door and an outer door are closed, of a refrigerator according to an embodiment of the present disclosure.

Reference will now be made in detail to embodiments of the present disclosure, examples of which are illustrated in the accompanying drawings, wherein like reference numerals refer to like components throughout.

Figure 2:
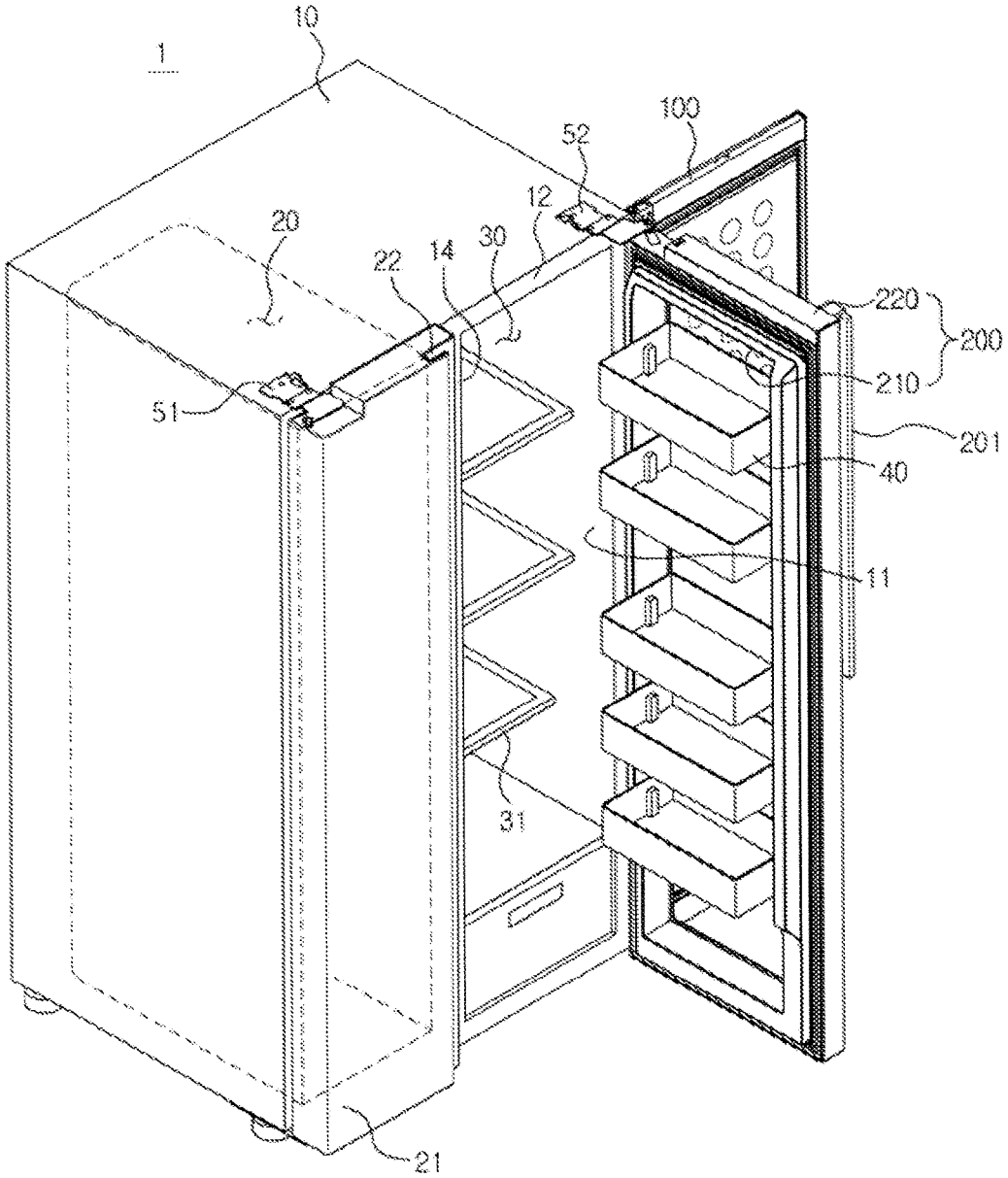
FIG. 2 is a view illustrating a state in which the inner door and the outer door of the refrigerator illustrated in FIG. 1 are individually opened.
Figure 3:
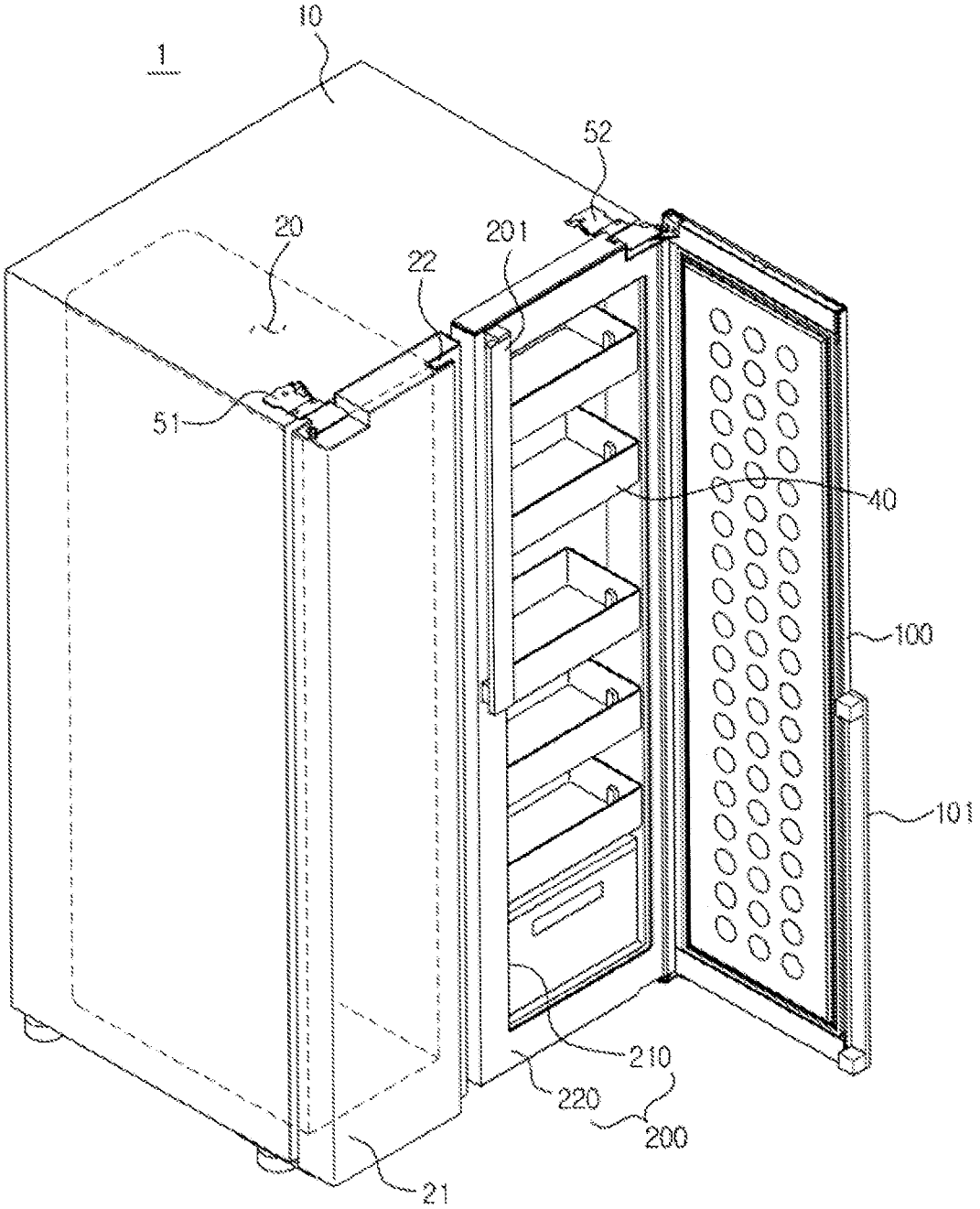
FIG. 3 is a view illustrating a state in which only the outer door of the refrigerator of FIG. 1 is opened.
Figure 4:
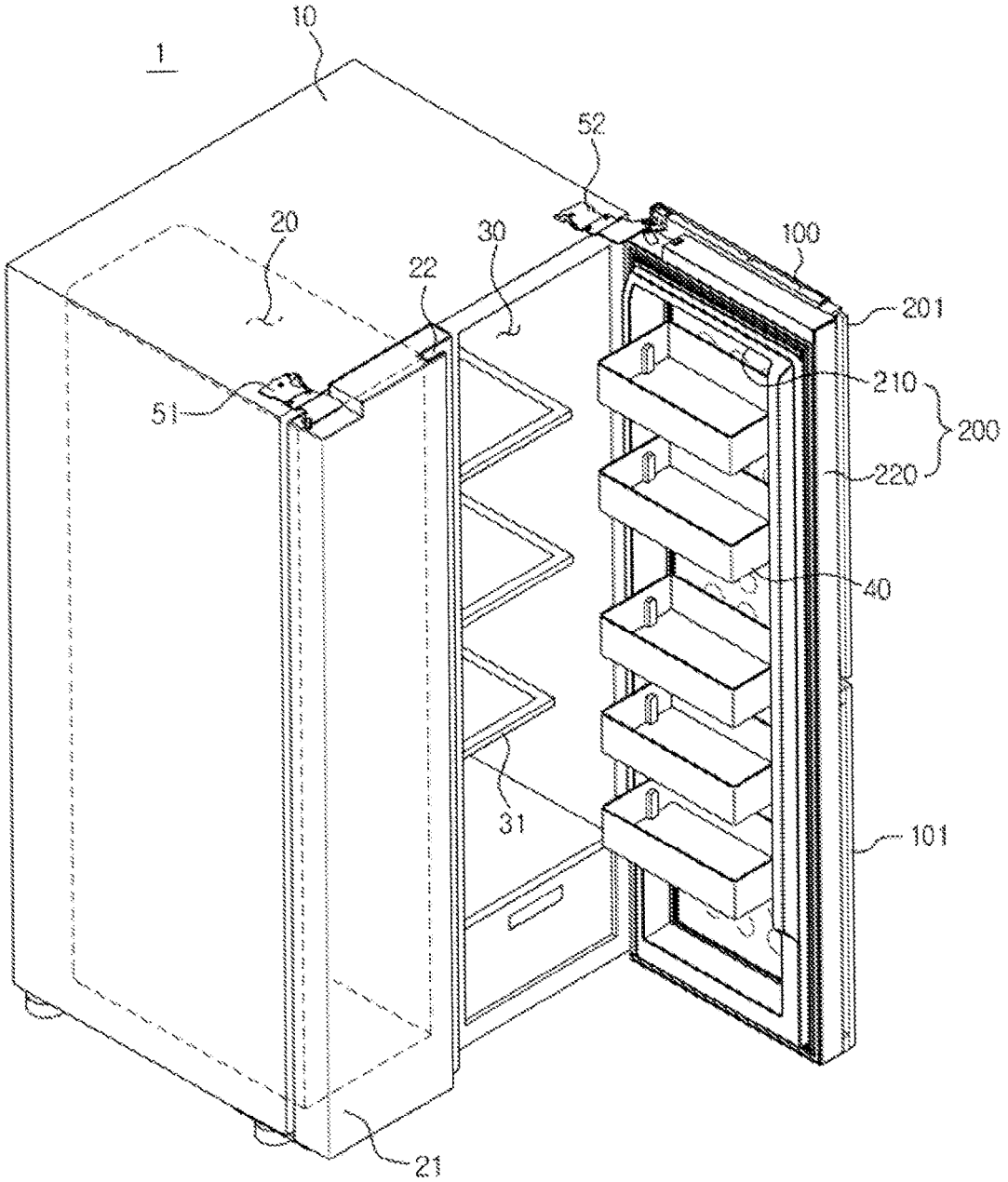
FIG. 4 is a view illustrating a state in which the inner door of the refrigerator of FIG. 1 is opened.

FIG. 1 is a view illustrating a state in which both an inner door and an outer door are closed, of a refrigerator according to an embodiment of the present disclosure, FIG. 2 is a view illustrating a state in which the inner door and the outer door of the refrigerator illustrated in FIG. 1 are individually opened, FIG. 3 is a view illustrating a state in which only the outer door of the refrigerator of FIG. 1 is opened, and FIG. 4 is a view illustrating a state in which the inner door of the refrigerator of FIG. 1 is opened.

Referring to FIGS. 1 through 4, a refrigerator 1 according to an embodiment of the present disclosure includes a body 10, storage compartments 20 and 30 disposed in the body 10, and a cold air supplying unit to supply cold air to the storage compartments 20 and 30.

The body 10 has an approximately box shape and includes an inner case 11 that constitutes the storage compartments 20 and 30, an outer case 12 that is combined with an outer portion of the inner case 11 and constitutes the exterior of the refrigerator 1, and a heat insulating material disposed between the inner case 11 and the outer case 12. The inner case 11 may be formed of, for example, a resin, and the outer case 12 may be formed of, for example, a metal.

The cold air supplying unit may include a compressor (not shown), a condenser (not shown), an expansion valve (not shown), and an evaporator (not shown) and may circulate a refrigerant and generate cold air using evaporated latent heat.

The storage compartments 20 and 30 may be partitioned off into a left freezer compartment 20 and a right refrigerator compartment 30 by an intermediate wall 14. However, the positions of the freezer compartment 20 and the refrigerator compartment 30 may be reversed. A shelf 31 on which food may be put, is disposed in the refrigerator compartment 30.

The freezer compartment 20 and the refrigerator compartment 30 may have open front portions via which food may be put in or taken out from the freezer compartment 20 and the refrigerator compartment 30, the open front portion of the freezer compartment 20 may be opened or closed by a freezer compartment door 21, and the open front portion of the refrigerator compartment 30 may be opened or closed by an outer door 100 and an inner door 200.

The freezer compartment door 21 may be rotatably combined with the body 10 using an upper hinge member 51 and a lower hinge member (not shown). The outer door 100 and the inner door 200 may be also rotatably combined with the body 10 using the upper hinge member 52 and the lower hinge member (not shown).

In this case, although not specifically shown, the outer door 100 and the inner door 200 may have different rotation shafts or may share one rotation shaft with each other.

The freezer compartment door 21, the outer door 100, and the inner door 200 may have a handle 22, a handle 101, and a handle 201, respectively.

The inner door 200 includes an opening 210 having a size that mostly corresponds to the size of the refrigerator compartment 30, and a door frame 220 that constitutes the opening 210. Thus, the door frame 220 may have an approximately rectangular frame shape.

A plurality of door guards 40 in which food may be accommodated, are disposed in the opening 210. Food having a mostly small height and a mostly small size or food that is frequently put in or taken out from the refrigerator compartment 30 may be stored in the plurality of door guards 40. The plurality of door guards 40 may be arranged in the opening 210 in a line in a vertical direction.

The outer door 100 has no opening and may have an approximately flat plate shape. Thus, the outer door 100 may open or close the opening 210 of the inner door 200.

In relation to an operation of using the inner door 200 and the outer door 100 of the refrigerator 1 having the above configuration according to an embodiment of the present disclosure, if the inner door 200 and the outer door 100 are closed, the refrigerator compartment 30 may be sealed, and cold air in the refrigerator compartment 30 may be preserved, as illustrated in FIG. 1.

As illustrated in FIG. 3, if the inner door 200 is closed and only the outer door 100 is opened, a user may approach the plurality of door guards 40 and may put food in the plurality of door guards 40 or may take out food from the plurality of door guards 40. In this state, a cold air outflow of the refrigerator compartment 30 may be suppressed compared to a state in which the inner door 200 is opened.

As illustrated in FIG. 4, if the inner door 200 is opened, the user may approach an inner portion of the refrigerator compartment 30 and may take out food stored in the shelf 31 or may put food in the shelf 31. Of course, in this case, the user may also approach the plurality of door guards 40 and may put food in the plurality of door guards 40 or may take out food from the plurality of door guards 40.

In this way, the refrigerator 1 according to an embodiment of the present disclosure may enable to put food in or take out food from the refrigerator 1 in various ways depending on a user's need. When food stored in the plurality of door guards 40 is put in or taken out from the door guards 40, only the outer door 100 is opened so that an outflow of cold air may be minimized.

Furthermore, since the door guards 40 of the refrigerator 1 according to an embodiment of the present disclosure has an enlarged storage space compared to the related art, variety in food storage and the effect of reducing the outflow of cold air may be more remarkably achieved.

Detailed configurations of the inner door 200, the outer door 100, and the door guards 40 of the refrigerator 1 according to an embodiment of the present disclosure will now be described.

Figure 5:
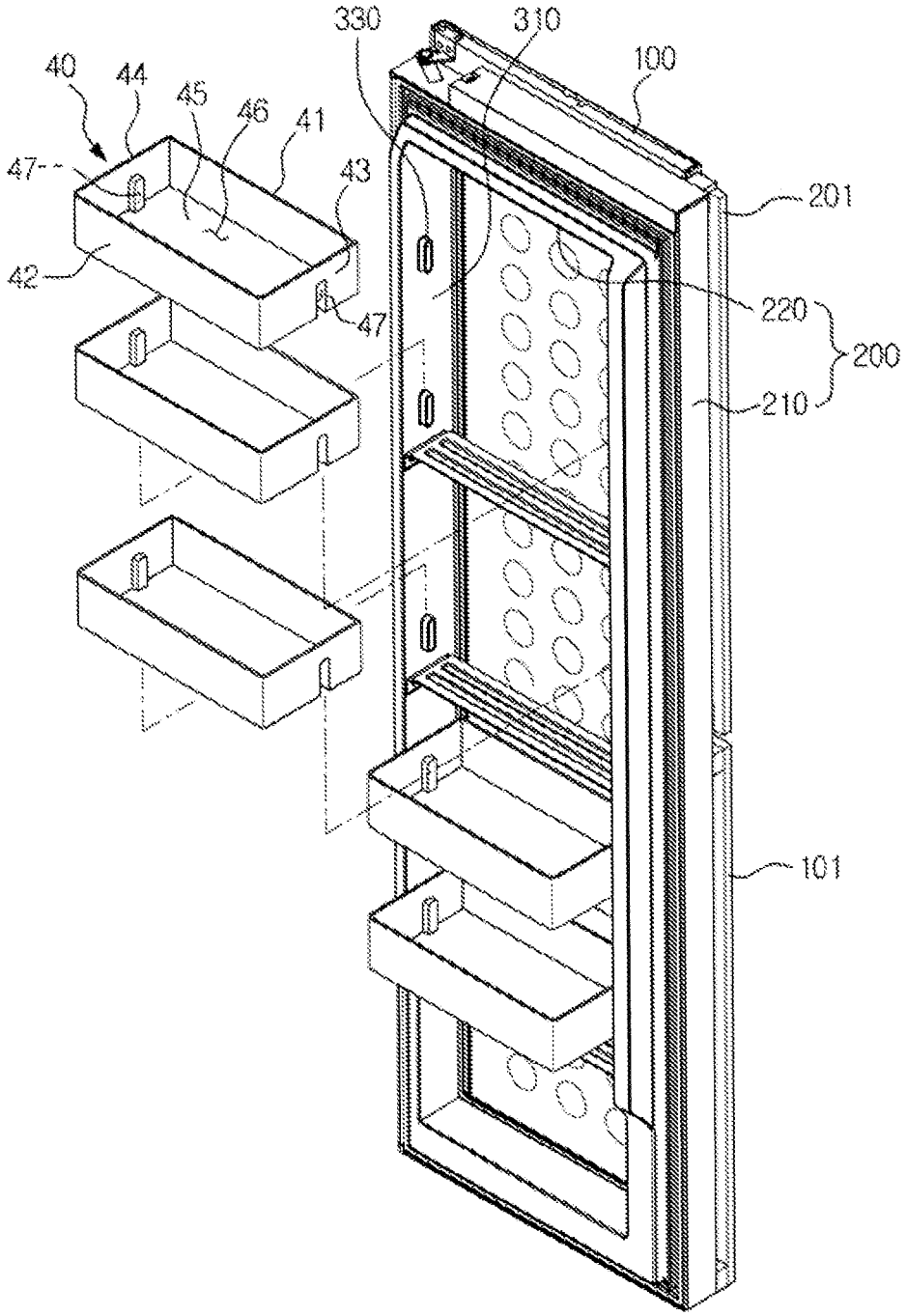
FIG. 5 is a view illustrating the inner door and a plurality of door guards of the refrigerator of FIG. 1.
Figure 6:
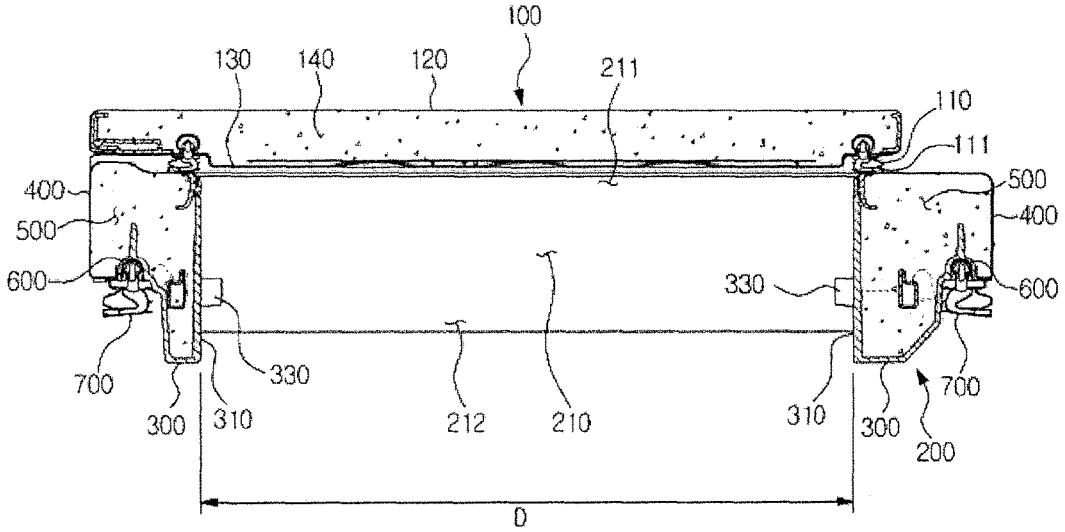
FIG. 6 is a cross-sectional view illustrating the inner door and the outer door of the refrigerator of FIG. 1.
Figure 7:
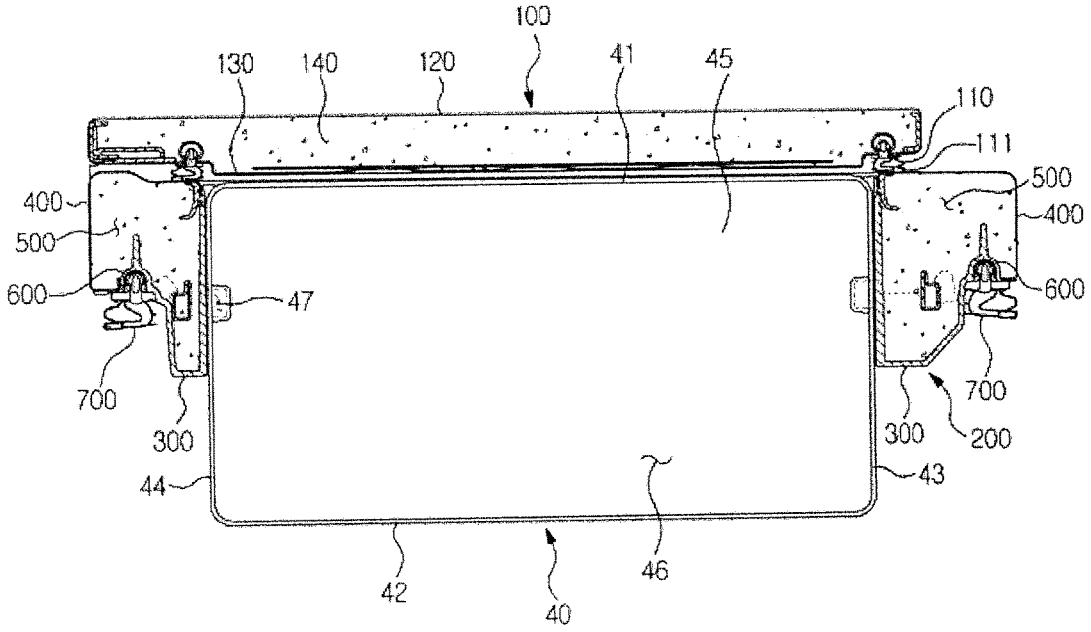
FIG. 7 is a cross-sectional view illustrating a state in which the plurality of door guards are mounted in the inner door of the refrigerator of FIG. 1.
Figure 8:
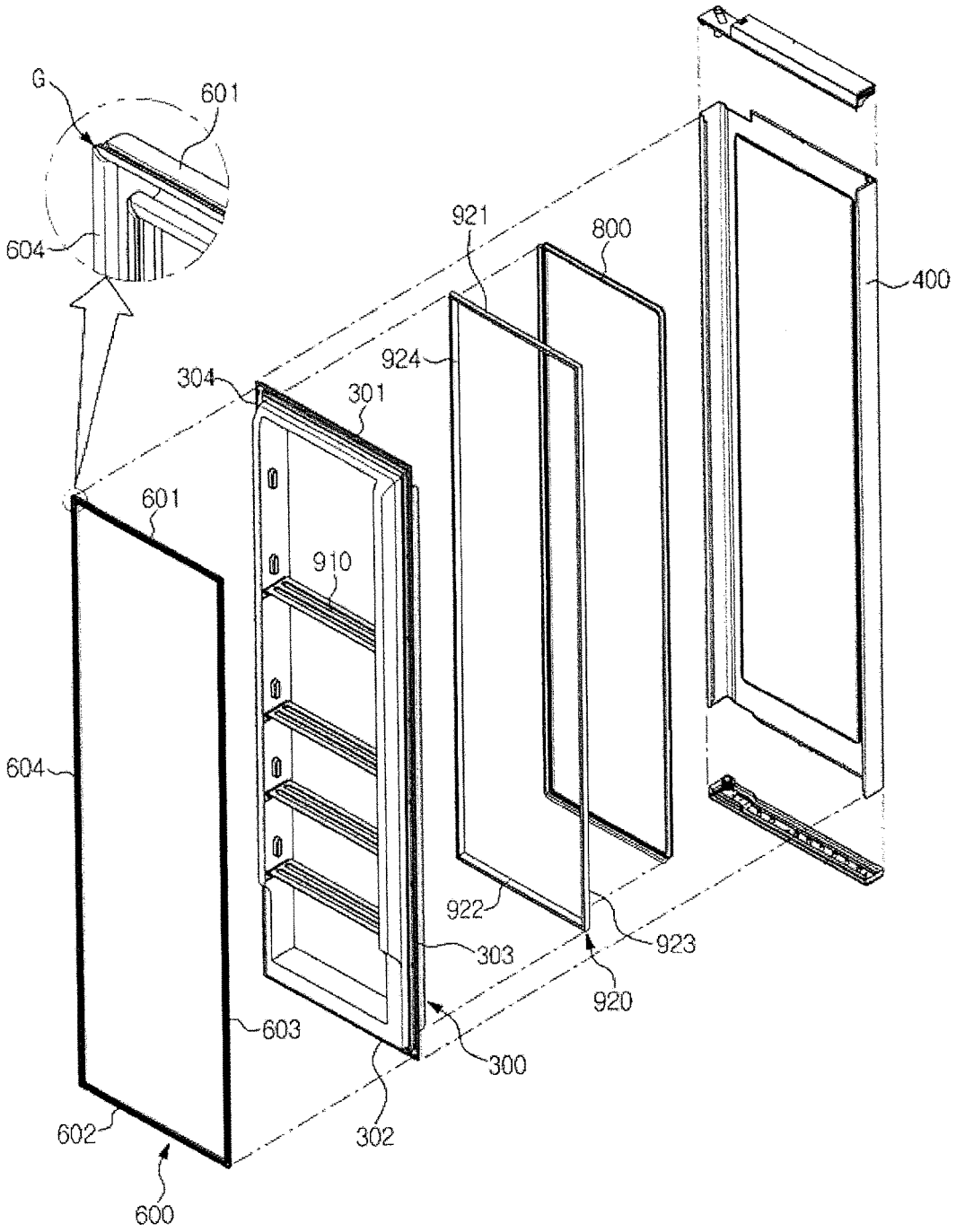
FIG. 8 is an exploded perspective view illustrating a configuration of the inner door of the refrigerator of FIG. 1.
Figure 9:
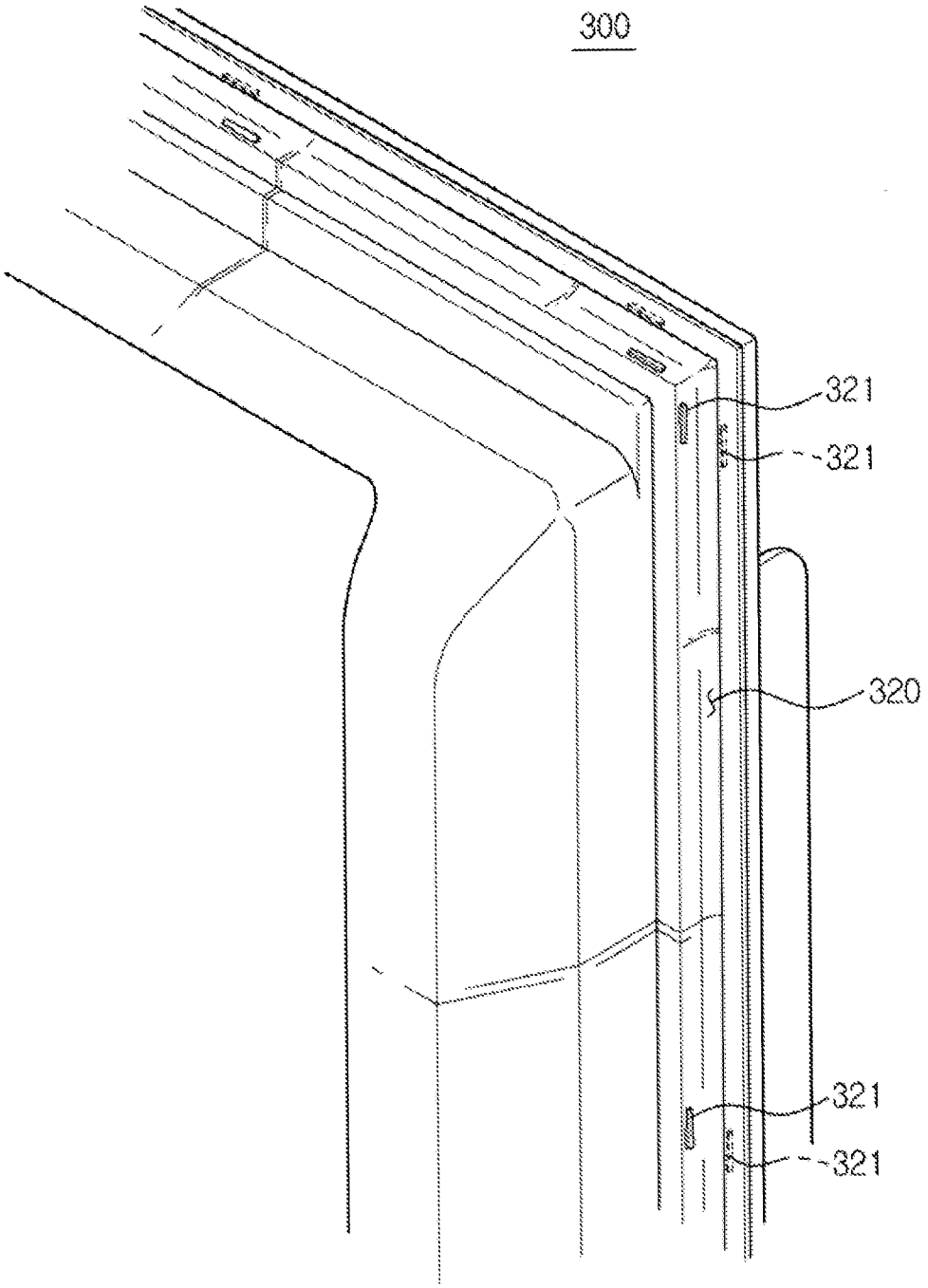
FIG. 9 is a view illustrating a part of an inner plate of the inner door of the refrigerator of FIG. 1.
Figure 10:
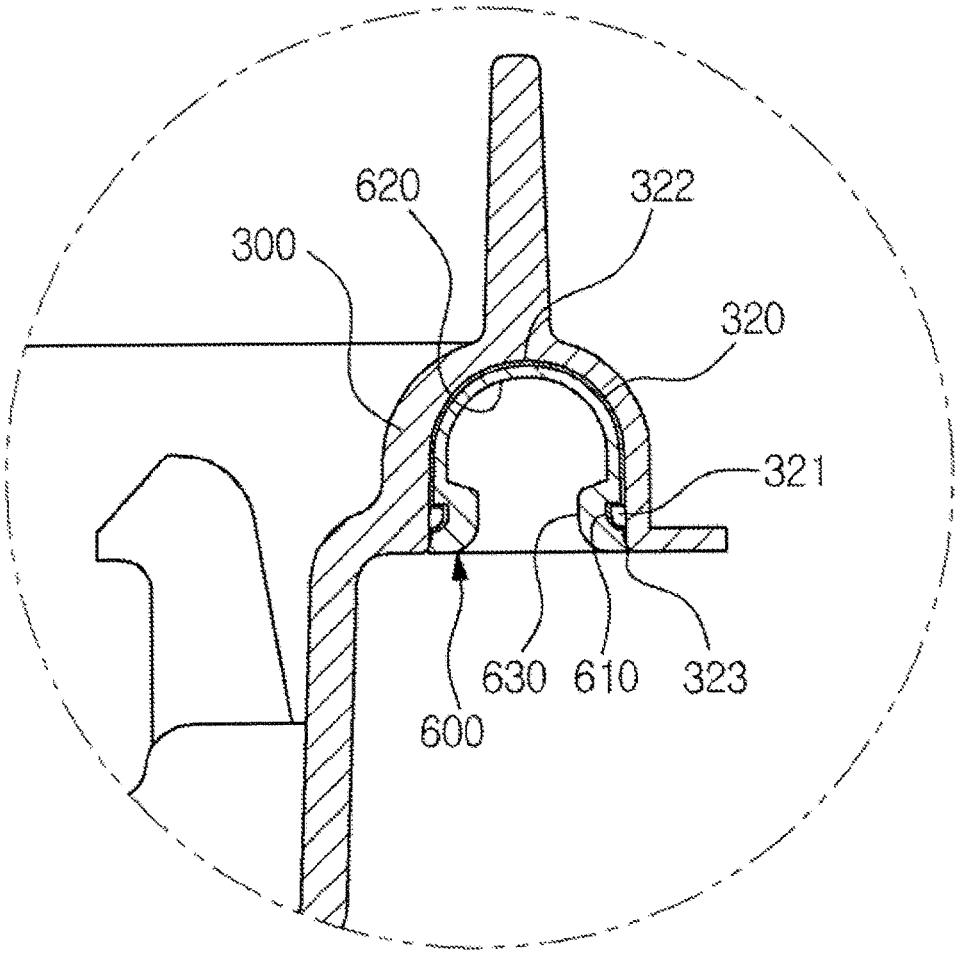
FIG. 10 is a cross-sectional view illustrating a state in which a plurality of installation members are accommodated in the inner plate of the inner door of the refrigerator of FIG. 1.
Figure 11:
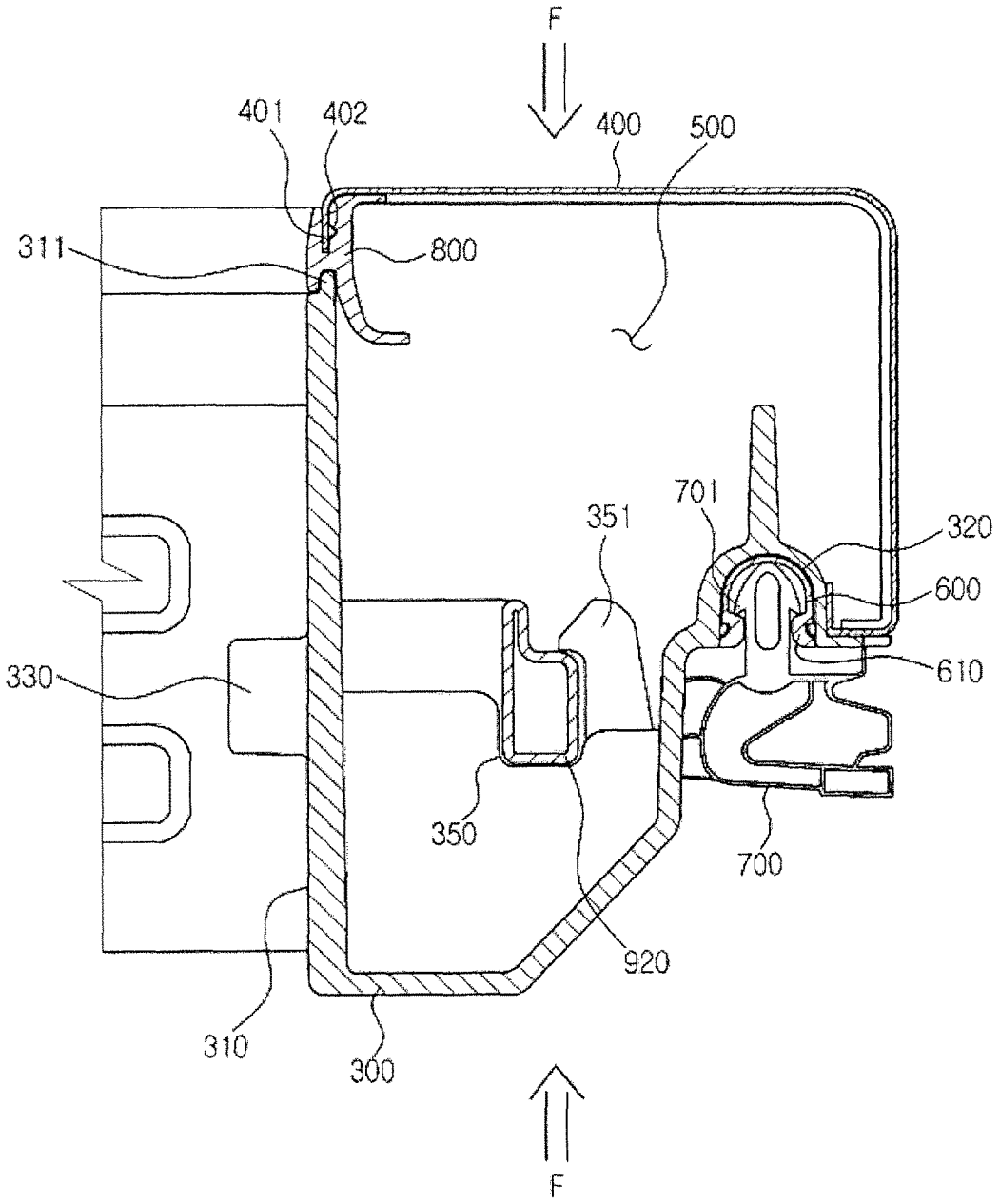
FIG. 11 is a cross-sectional view illustrating a part of the inner door of the refrigerator of FIG. 1.
Figure 12:
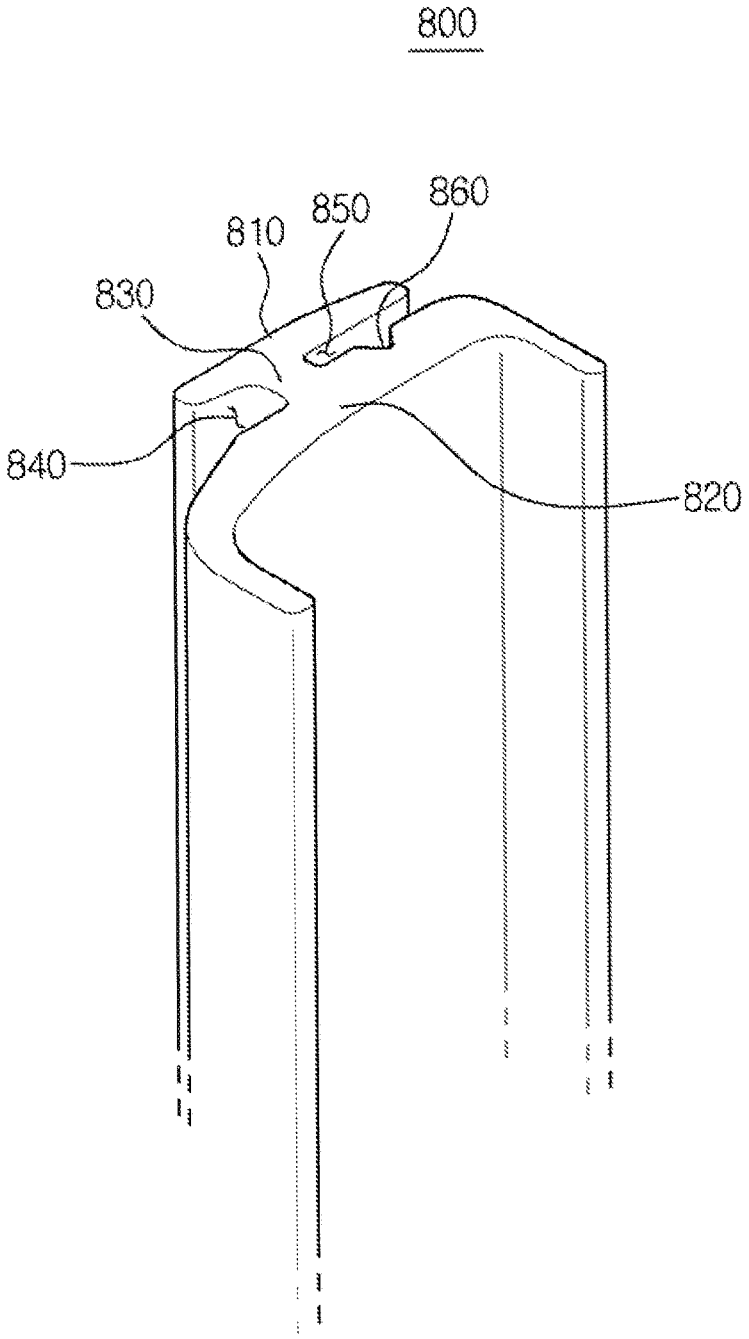
FIG. 12 is a view illustrating a door trim of the refrigerator of FIG. 1.

FIG. 5 is a view illustrating the inner door and a plurality of door guards of the refrigerator of FIG. 1, FIG. 6 is a cross-sectional view illustrating the inner door and the outer door of the refrigerator of FIG. 1, FIG. 7 is a cross-sectional view illustrating a state in which the plurality of door guards are mounted on the inner door of the refrigerator of FIG. 1, FIG. 8 is an exploded perspective view illustrating a configuration of the inner door of the refrigerator of FIG. 1, FIG. 9 is a view illustrating a part of an inner plate of the inner door of the refrigerator of FIG. 1, FIG. 10 is a cross-sectional view illustrating a state in which a plurality of installation members are accommodated in the inner plate of the inner door of the refrigerator of FIG. 1, FIG. 11 is a cross-sectional view illustrating a part of the inner door of the refrigerator of FIG. 1, and FIG. 12 is a view illustrating a door trim of the refrigerator of FIG. 1.

As illustrated in FIG. 5, the door guards 40 may have, for example, an approximately box shape. Thus, the door guards 40 each may have a front wall 41, a rear wall 42, a left wall 43, a right wall 44, a bottom wall 45, and a storage space 46 in which food is stored. A support groove 47 may be formed in each of the left wall 43 and the right wall 44 of each door guard 40.

The inner door 200 may include inner sidewalls 310 disposed at both sides of the opening 210 so as to support the door guards 40, and support protrusions 330 may protrude from the inner sidewalls 310 and may be inserted into the support grooves 47 of each door guard 40.

Thus, the support protrusions 330 may be inserted into the support grooves 47 so that the door guards 40 may be mounted in the opening 210. These door guards 40 may also be detached from the opening 210. Also, although not shown, the door guards 40 may be disposed to be slidable in a forward/backward direction or the vertical direction.

As illustrated in FIG. 8, the inner door 200 may include an inner plate 300, an outer plate 400, which is combined with the inner plate 300 and in which a foaming space (see 500 of FIG. 6) between the outer plate 400 and the inner plate 300 is formed, a plurality of installation members 600, which are combined with a rear surface of the inner plate 300 and at which a gasket (see 700 of FIG. 6) is installed, a plurality of reinforcement members 910 and 920 that prevent distortion of the inner door 200, and a door trim 800 that is combined in a space between an end portion of the inner plate 300 and an end portion of the outer plate 400 so as to prevent a foaming solution that foams in the foaming space (see 500 of FIG. 6) from leaking.

The inner plate 300 may include an upper frame 301, a lower frame 302, a left frame 303, and a right frame 304, and may be integrally injection-molded using a resin. The outer plate 400 may be formed of a metal.

As illustrated in FIG. 6, the inner plate 300 includes a plurality of inner sidewalls 310 disposed at both sides of the opening 210. The plurality of inner sidewalls 310 may constitute the opening 210 and simultaneously may support the door guards (see 40 of FIG. 7).

In this case, the inner sidewalls 310 are formed flat from an inlet 211 of the opening 210 to an outlet 212 of the opening 210 without any curve. In addition, a distance D between the plurality of inner sidewalls 310 may be uniform from the inlet 211 of the opening 210 to the outlet 212 of the opening 210.

The inner sidewalls 310 may be formed flat in this way is to maximize the size of the opening 210. The inner plate 300 may be formed by injection molding (not by vacuum molding) in order to form the inner sidewalls 310 flat.

Vacuum molding is a technique, whereby air between a resin sheet and a mold is absorbed and the resin sheet is closely adhered to the mold so as to perform molding. Cost for performing vacuum molding is lower than that of injection molding, and molding may be more easily performed in the vacuum molding technique than in an injection molding technique. However, since the resin sheet needs to be closely adhered to the mold, it is difficult to form a flat surface perpendicular to the mold.

As illustrated in FIG. 7, each door guard 40 may be disposed to approximately contact the inlet 211 of the opening 210 so that the front wall 41 of the door guard 40 forms a part of a front portion of the inner door 200, and the front wall 41 of the door guard 40 may not be covered by the inner door 200 and may be fully exposed.

Through this structure, the door guards 40 may occupy all of the area of the opening 210, and the size of each door guard 40 may be maximized. Also, since the door guards 40 are fully exposed when viewed from an outside of the inner door 200, the state of food stored in the door guards 40 may be easily checked.

In this way, the door guards 40 of the refrigerator 1 of FIG. 1 may be disposed in the opening 210 of the inner door 200 and may not be disposed at a rear portion of the outer door 100.

The outer door 100 may include an outer door inner plate 130, an outer door outer plate 120, a heat insulating material 140 disposed between the outer door inner plate 130 and the outer door outer plate 120, and a gasket 110.

The outer door inner plate 130 may be vacuum-molded using a resin, and the outer door outer plate 120 may be formed of, for example, a metal. The gasket 110 may include a magnet 111, and the magnet 111 may interact with the outer plate 400 that is formed of, for example, a metal and constitutes the inner door 200.

The plurality of installation members 600 may be used to minimize the usage of a complicated mold, such as a slide core, when the inner plate 300 is injection-molded and may be used to install the gasket 700 in the inner plate 300. The installation members 600 are combined with a border of the rear surface of the inner plate 300.

The plurality of installation members 600 may include a first installation member 601 combined with the upper frame 301 of the inner plate 300, a second installation member 602 combined with the lower frame 302 of the inner plate 300, a third installation member 603 combined with the left frame 303 of the inner plate 300, and a fourth installation member 604 combined with the right frame 304 of the inner plate 300, as illustrated in FIG. 8.

For the convenience, in the present specification and the drawings, the first installation member 601, the second installation member 602, the third installation member 603, and the fourth installation member 604 are commonly called the installation members 600 when they do not need to be specifically differentiated therebetween.

In this case, the first installation member 601, the second installation member 602, the third installation member 603, and the fourth installation member 604 may be disposed spaced apart from each other by a predetermined gap G without being connected to each other. Thus, the first installation member 601, the second installation member 602, the third installation member 603, and the fourth installation member 604 may be prevented from interfering with each other due to thermal expansion.

As illustrated in FIGS. 9 and 10, an accommodation groove 320 in which the installation members 600 may be accommodated, may be formed in the border of the rear surface of the inner plate 300. In this case, the accommodation groove 320 may be formed in such a way that a cross-sectional area of the accommodation groove 320 increases gradually as it gets closer to a shallowest position 323 from a deepest position 322. That is, the accommodation groove 320 may be formed using a general mold, instead of a complicated mold, such as a slide core.

However, a plurality of minimum accommodation protrusions 321 may protrude toward the accommodation groove 320 so as to fix the installation members 600. Thus, the plurality of accommodation protrusions 321 may not be formed in the entire region of the accommodation groove 320 but may be formed only in a part of the accommodation groove 320. The plurality of accommodation protrusions 321 may be formed spaced apart from each other.

The installation members 600 each may include an installation groove 620 in which a gasket (see 700 of FIG. 11) is installed, installation protrusions 630 that protrude toward an inner portion of the installation groove 620 so as to fix the gasket 700, and an insertion groove 610 in which the accommodation protrusions 321 of the inner plate 300 are inserted.

The installation protrusions 630 may interfere with fixing protrusions (see 701 of FIG. 11) of the gasket 700 to fix the gasket 700. The installation groove 620 and the installation protrusions 630 of the installation members 600 may be easily formed integrally with each other through extrusion molding.

Thus, in the refrigerator 1 according to an embodiment of the present disclosure, each installation member 600 is inserted into the accommodation groove 320 formed in the inner plate 300 of the inner door 200, and the gasket 700 is inserted into the installation groove 620 formed in the installation member 600 such that the gasket 700 may be installed in the inner plate 300. In this procedure, the inner plate 300 may be injection-molded using a simple mold, and the installation members 600 may be, for example, extrusion-molded.

The door trim 800 prevents the foaming solution in the foaming space 500 between the inner plate 300 and the outer plate 400 from leaking and may include a first insertion groove 840 in which an end 311 of the inner sidewall 310 of the inner plate 300 is closely adhered and inserted, and a second insertion groove 850 in which an end 401 of the outer plate 400 is closely adhered and inserted, as illustrated in FIGS. 11 and 12.

Also, the door trim 800 may include a first support part 810 that supports the inner plate 300 and the outer plate 400 from an outer portion of the door trim 800, a second support part 820 that supports the inner plate 300 and the outer plate 400 from an inner portion of the door trim 800, and a connection part 830 that connects the first support part 810 and the second support part 820 each other.

Also, a combination groove 860 in which a combination protrusion 402 of the outer plate 400 is inserted, may be formed in the second support part 820 so as to enhance a combination force between the door trim 800 and the outer plate 400.

A foaming process of the inner door 200 including the door trim 800 will now be described.

First, after the inner plate 300, the outer plate 400, and the door trim 800 are preparatorily combined with each other, the inner plate 300 is put to be directed toward a bottom surface, the outer plate 400 is put to be upwardly directed, and the inner plate 300 and the outer plate 400 are pressurized in the vertical direction (see F of FIG. 11) using a fixing jig (not shown).

Next, the foaming solution is injected and foams in the foaming space 500 between the inner plate 300 and the outer plate 400. In this case, since the inner plate 300 and the outer plate 400 are pressurized in the vertical direction F, a space between the inner plate 300 and the outer plate 400 may not be widened due to a foaming pressure in the vertical direction F so that the foaming solution may not leak in the vertical direction F.

Also, since the door trim 800 securely holds the end portion 311 of the inner plate 300 and the end 401 of the outer plate 400, the space between the inner plate 300 and the outer plate 400 may not be widened due to the foaming pressure in a horizontal direction so that the foaming solution may not leak.

If no door trim 800 is present, even when the inner plate 300 and the outer plate 400 toward the opening 210 are disposed to overlap each other, the space between the inner plate 300 and the outer plate 400 may be widened due to the foaming pressure, and the foaming solution may leak.

If foaming of the foaming solution is completed in the foaming space 500, the inner plate 300, the outer plate 400, and the door trim 800 may be securely combined with each other due to an adhesive force of the foaming solution.

The inner door 200 of the refrigerator 1 according to the present disclosure has the opening 210 and thus is vulnerable to distortion. Also, due to the foaming pressure in the foaming process of the inner door 200, distortion may occur in the inner door, or the inner sidewalls 310 may not be uniformly formed. In order to supplement this, the plurality of reinforcement members (see 910 and 920 of FIG. 8) may be disposed in the inner door 200.

The plurality of reinforcement members 910 and 920 may include first reinforcement members 910 that connect the left frame 303 of the inner plate 300 and the right frame 304 of the inner plate 300 across the opening 210 and second reinforcement members 920 that are disposed in the upper frame 301 of the inner plate 300, the lower frame 302 of the inner plate 300, the left frame 303 of the inner plate 300, and the right frame 304 of the inner plate 300.

The first reinforcement members 910 will be described later, and the configuration of the second reinforcement members 920 will now be described. The second reinforcement members 920 each may include an upper reinforcement part 921, a lower reinforcement part 922, a left reinforcement part 923, and a right reinforcement part 924, and may be disposed to have an approximately rectangular frame shape. The second reinforcement members 920 each may be formed of a metal having rigidity integrally with each other.

As illustrated in FIG. 11, an accommodation space 350 in which each second reinforcement member 920 is accommodated, and a hook part 351 that fixes the second reinforcement member 920, may be formed in the inner plate 300. Thus, the second reinforcement member 920 may be combined with the inner plate 300 and may be disposed in a space between the inner plate 300 and the outer plate 400. Thus, the second reinforcement member 920 may not be exposed to the outside.

The second reinforcement member 920 may be fixed to the inner plate 300 before the foaming solution foams in the foaming space 500 between the inner plate 300 and the outer plate 400.

Figure 13:
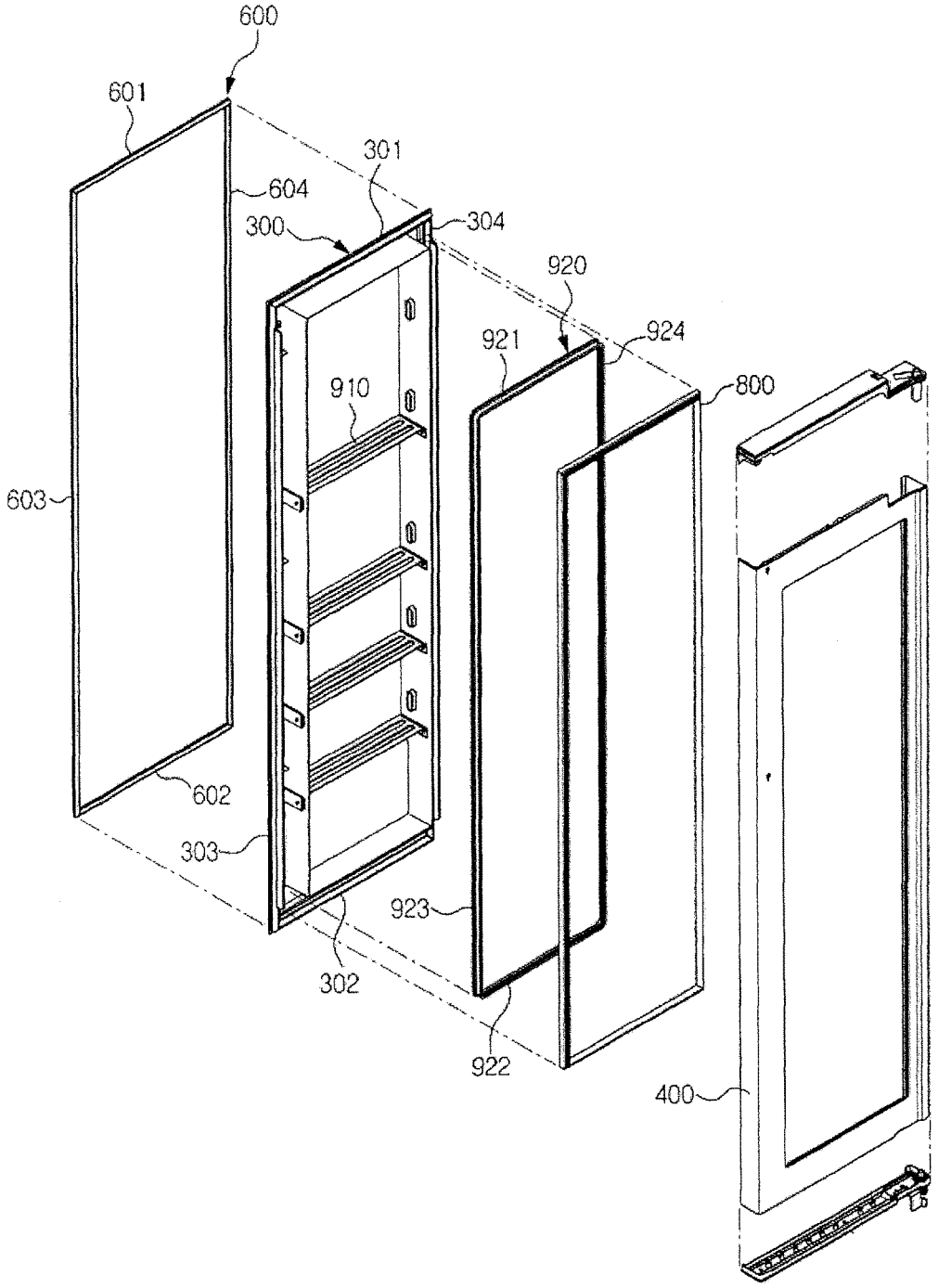
FIG. 13 is an exploded perspective view of the configuration of the inner door of the refrigerator of FIG. 1 at an angle different from that of FIG. 8.
Figure 14:
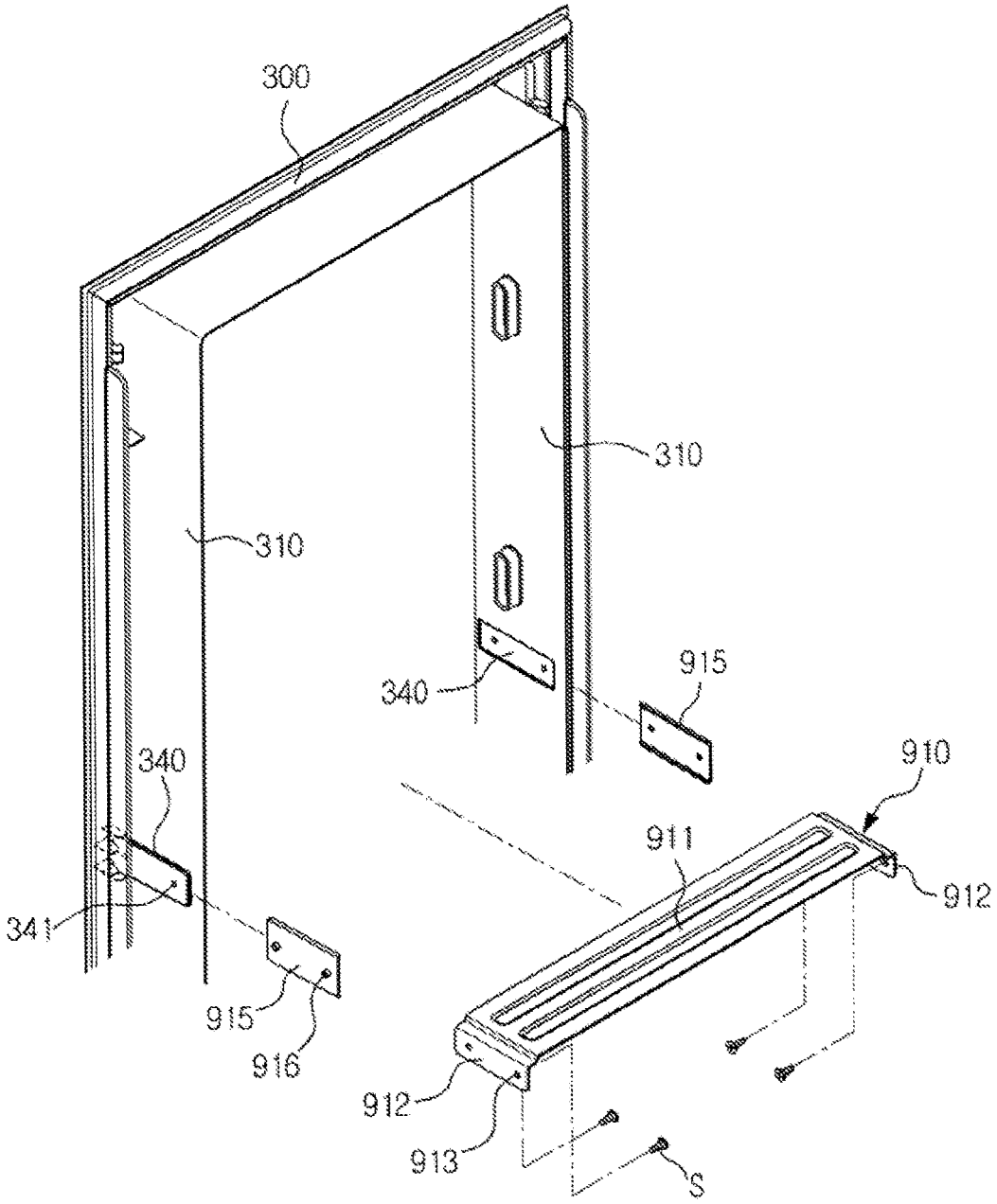
FIG. 14 is an exploded perspective view illustrating a combined structure of a first reinforcement member of the refrigerator of FIG. 1.
Figure 15:
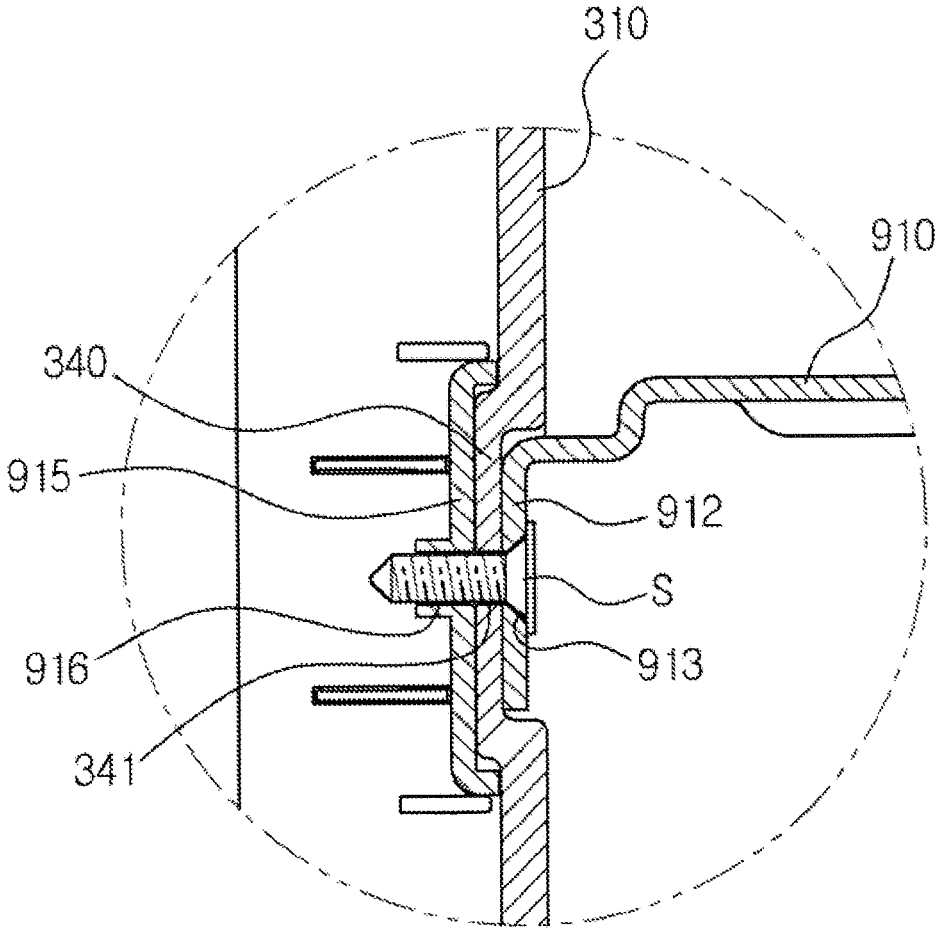
FIG. 15 is a cross-sectional view illustrating a combined structure of the first reinforcement member of the refrigerator of FIG. 1.

FIG. 13 is an exploded perspective view of the configuration of the inner door of the refrigerator of FIG. 1 at an angle different from that of FIG. 8, FIG. 14 is an exploded perspective view illustrating a combined structure of a first reinforcement member of the refrigerator of FIG. 1, and FIG. 15 is a cross-sectional view illustrating a combined structure of the first reinforcement member of the refrigerator of FIG. 1.

Referring to FIGS. 13 through 15, the first reinforcement members 910 may be fastened to the inner sidewalls 310 of the inner plate 300 via fastening members S. The fastening members S may be, for example, screws. Recess parts 340 with which the first reinforcement members 910 are combined, may be formed in the inner sidewalls 310.

The first reinforcement members 910 each may include a connection part 911 that crosses the opening 210 and a plurality of combination parts 912 that are bent from both end portions of the connection part 911 and are closely adhered to the recess parts 340.

Fastening holes 913 through which the fastening members S pass, may be formed in the combination parts 912, and fastening holes 341 through which the fastening members S pass, may be formed in the recess parts 340 of the inner sidewalls 310.

Also, patch plates 915 may be combined with opposite sides to the first reinforcement members 910 based on the inner sidewalls 310 so as to reinforce a fastening force via the fastening members S. Fastening holes 916 through which the fastening members S pass, may be formed in the patch plates 915. Thus, the fastening members S may pass through the first reinforcement member 910, the inner sidewall 310, and the patch plate 915 successively.

In this way, the first reinforcement members 910 connect the left frame 303 of the inner plate 300 having a relatively large length and the right frame 304 of the inner plate 300 across the opening 210 to prevent distortion of the inner door 200, and the second reinforcement members 920 are disposed in the upper frame 301 of the inner plate 300, the lower frame 302 of the inner plate 300, the left frame 303 of the inner plate 300, and the right frame 304 of the inner plate 300 to prevent distortion of the inner door 200 through four-side reinforcement.

In an embodiment of the present disclosure, both the first reinforcement members 910 and the second reinforcement members 920 are disposed. However, either of the first reinforcement members 910 and the second reinforcement members 920 may be disposed depending on a need.

According to the spirit of the present disclosure, both inner sidewalls of an inner plate disposed at both sides of an opening are flat from an inlet of the opening to an outlet of the opening, and a plurality of door guards are disposed between both inner sidewalls of the inner plate so that a storage space of the plurality of door guards may be enlarged.

In addition, since no part of a front wall of the door guards is covered by an inner door, the state of food stored in the door guards may be easily checked.

In addition, since a door trim is combined with an end portion of the inner plate and an end portion of an outer plate, a foaming solution that foams in a space between the inner plate and the outer plate may be prevented from leaking toward the opening.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a body;

a storage compartment formed in the body;

an inner door comprising an opening corresponding to the storage compartment, an inner plate, an outer plate, and a heat insulating material that foams between the inner plate and the outer plate, the inner door rotatably combined with the body;

a door trim coupled between the inner plate and the outer plate to prevent the heating insulating material from leaking;

a plurality of door guards disposed in the opening; and an outer door rotatably combined with the body so as to open or close the opening, wherein the inner plate comprises a plurality of inner sidewalls that constitute the opening and support the plurality of door guards, the plurality of inner sidewalls are flat from an inlet of the opening to an outlet of the opening and a distance between the plurality of inner sidewalls is uniform from the inlet of the opening to the outlet of the opening, and the door trim is disposed in the inlet of the opening.

2. The refrigerator according to claim 1, wherein the door trim further comprises a first insertion groove and an end portion of the inner plate which is inserted into the first insertion groove, and wherein the door trim further comprises a second insertion groove and an end portion of the outer plate which is inserted into the second insertion groove.

3. The refrigerator according to claim 1, wherein the outer plate comprises a combination protrusion via which the outer plate is combined with the door trim, and the door trim comprises a combination groove in which the combination protrusion is inserted.

4. The refrigerator according to claim 1, further comprising support protrusions that protrude from the plurality of inner sidewalls so as to support the plurality of door guards which are removable from the inner sidewalls of the inner door.

5. The refrigerator according to claim 1, wherein the plurality of door guards each comprises a front wall, a rear wall, both sidewalls, a bottom wall, and a storage space.

6. The refrigerator according to claim 5, wherein the front wall of each door guard constitutes a part of a front portion of the inner door and is fully exposed when the outer door is opened.

7. The refrigerator according to claim 1, wherein the plurality of inner side walls are parallel so as to the plurality of door guards are slidable in a forward/backward direction or the vertical direction.

* * * * *